US007434696B2

(12) United States Patent
Soto

(10) Patent No.: US 7,434,696 B2
(45) Date of Patent: Oct. 14, 2008

(54) INLET HEAD FOR A CYCLONE SEPARATOR

(75) Inventor: Oscar Castro Soto, Santiago (CL)

(73) Assignee: Vulco, S.A., Santiago (CL)

( * ) Notice: Subject to any disclaimer, the term of this patent is extended or adjusted under 35 U.S.C. 154(b) by 60 days.

(21) Appl. No.: 10/569,671

(22) PCT Filed: Aug. 27, 2004

(86) PCT No.: PCT/AU2004/001152

§ 371 (c)(1),
(2), (4) Date: Feb. 27, 2006

(87) PCT Pub. No.: WO2005/021162

PCT Pub. Date: Mar. 10, 2005

(65) Prior Publication Data

US 2006/0226055 A1 Oct. 12, 2006

(30) Foreign Application Priority Data

Aug. 29, 2003 (CL) ..... 1757-2003

(51) Int. Cl.
*B04C 5/02* (2006.01)

(52) U.S. Cl. ..... 209/732

(58) Field of Classification Search ..... 209/727, 209/732–734; 210/512.1
See application file for complete search history.

(56) References Cited

U.S. PATENT DOCUMENTS 2,757,581 A * 8/1956 Boadway et al. ..... 209/730
2,849,930 A * 9/1958 Boadway et al. ..... 95/261
4,344,538 A 8/1982 Fujisawa et al.

(Continued)

FOREIGN PATENT DOCUMENTS

DE 3524789 A1 1/1987

(Continued)

*Primary Examiner*—Joseph C Rodriguez
(74) *Attorney, Agent, or Firm*—Morriss O'Bryant Compagni

(57) ABSTRACT

An inlet head for a cyclone, the inlet head including a feed chamber therein having an inner side wall, an end wall at one end of the side wall, an open end at the other end of the side wall, the open end being of circular cross-section with a central axis. The inlet head further includes an inlet port adjacent the end wall for delivering material to be separated to the feed chamber, the inlet port having a feed height dimension H1 in the direction of the central axis, an overflow outlet in the end wall which is coaxial with the central axis, a vortex finder at the end wall or extending into the feed chamber in the direction of the central axis a distance L1 from the end wall, and a feed inlet zone in the inner side wall of the feed chamber having an upstream end adjacent the inlet port and a downstream end. The feed inlet zone is in the form of a volute having a volute axis extending around the inner side wall and including a first sector in which the volute is generally at right angles to the central axis and a second sector in which the volute extends around the side wall generally in the direction of the central axis away from the end wall wherein the distance from the volute axis to the central axis decreases with the progression of the volute from the inlet port, and the distance L1 is a fraction F of the feed height dimension H1.

12 Claims, 3 Drawing Sheets

U.S. PATENT DOCUMENTS

| | | | | |
|---|---|---|---|---|
| 5,518,695 | A * | 5/1996 | Goodspeed et al. | 422/144 |
| 5,958,094 | A * | 9/1999 | Schwamborn et al. | 55/331 |
| 6,258,146 | B1 * | 7/2001 | Semedard | 55/459.3 |
| 7,185,765 | B2 * | 3/2007 | Hakola | 209/734 |

FOREIGN PATENT DOCUMENTS

| | | | |
|---|---|---|---|
| SU | 1217-487 | A | 3/1986 |
| SU | 1625-531 | A | 2/1991 |
| WO | WO 86/01130 | | 2/1986 |

* cited by examiner

INLET HEAD FOR A CYCLONE SEPARATOR

BACKGROUND OF THE INVENTION

1. Field of the Invention

This invention relates generally to cyclone separators for separating or classifying materials and components therefor.

2. Description of Related Art

One particular application of the present invention concerns the provision of a hydrocyclone for separating or classifying slurries in the mineral processing industry. The improvements in the cyclone separator of the present invention is not limited to that particular application and may find use in the separation of other materials.

Various types of separation of classification apparatus are used in the mineral industry, one commonly used apparatus being hydrocyclones. There is an ongoing need for apparatus to increase the throughput capacity, decrease the cut size, and improve the efficiency of operation. To significantly increase the throughput capacity, it has in the past been necessary to increase the size of the hydrocyclone. Increasing the size of the hydrocyclone however suffers from the disadvantage that it generally results in a bigger cut size and reduced efficiency.

BRIEF SUMMARY OF THE INVENTION

According to one aspect of the present invention there is provided an inlet head for a cyclone, the inlet head including a feed chamber therein having an inner side wall, a top or end wall at one end of the side wall, an open end at the other end of the side wall, the open end being of circular cross section with a central axis, an inlet port adjacent the top or end wall for delivering material to be separated to the feed chamber, the inlet port having a feed height dimension H1 in the direction of the central axis, an overflow outlet in the top or end wall which is coaxial with the central axis, a vortex finder at the top or end wall or extending into the feed chamber in the direction of the central axis a distance L1 from the top or end wall, and a feed inlet zone in the inner side wall of the feed chamber having an upstream end adjacent the inlet port and a downstream end, the feed inlet zone being in the form of a volute having a volute axis extending around the inner side wall and including a first sector, or surface S 1, in which the volute is generally flat to the horizontal plane, and second sector in which the volute descends (surface S2). This surface extends around the side wall generally in the direction of the central axis away from the top or end wall wherein the distance from the volute axis to the central axis decreases with the progression of the volute from the inlet port, and the distance L1 is a fraction F of the feed height dimension H1 (FIG. 2). In a preferred form the inlet port is generally rectangular in cross section.

Preferably the fraction F is from 0 to 0.95. Preferably the first sector progresses from the inlet port around the inner side wall for an angle al which ranges from 0° to 100°. Preferably the second sector extends in the direction of the central axis over a distance D ranging from 0.25 to 1 H1 for every 90° of progress around the inner side wall. The curve yielding the variation of the generatrix radius with the angle at the center may, for example, be a straight line or convex curve.

BRIEF DESCRIPTION OF THE SEVERAL VIEWS OF THE DRAWINGS

Preferred embodiments of the invention will hereinafter be described with reference to the accompanying drawings and in those drawings.

DETAILED DESCRIPTION OF THE INVENTION

Figure 1:
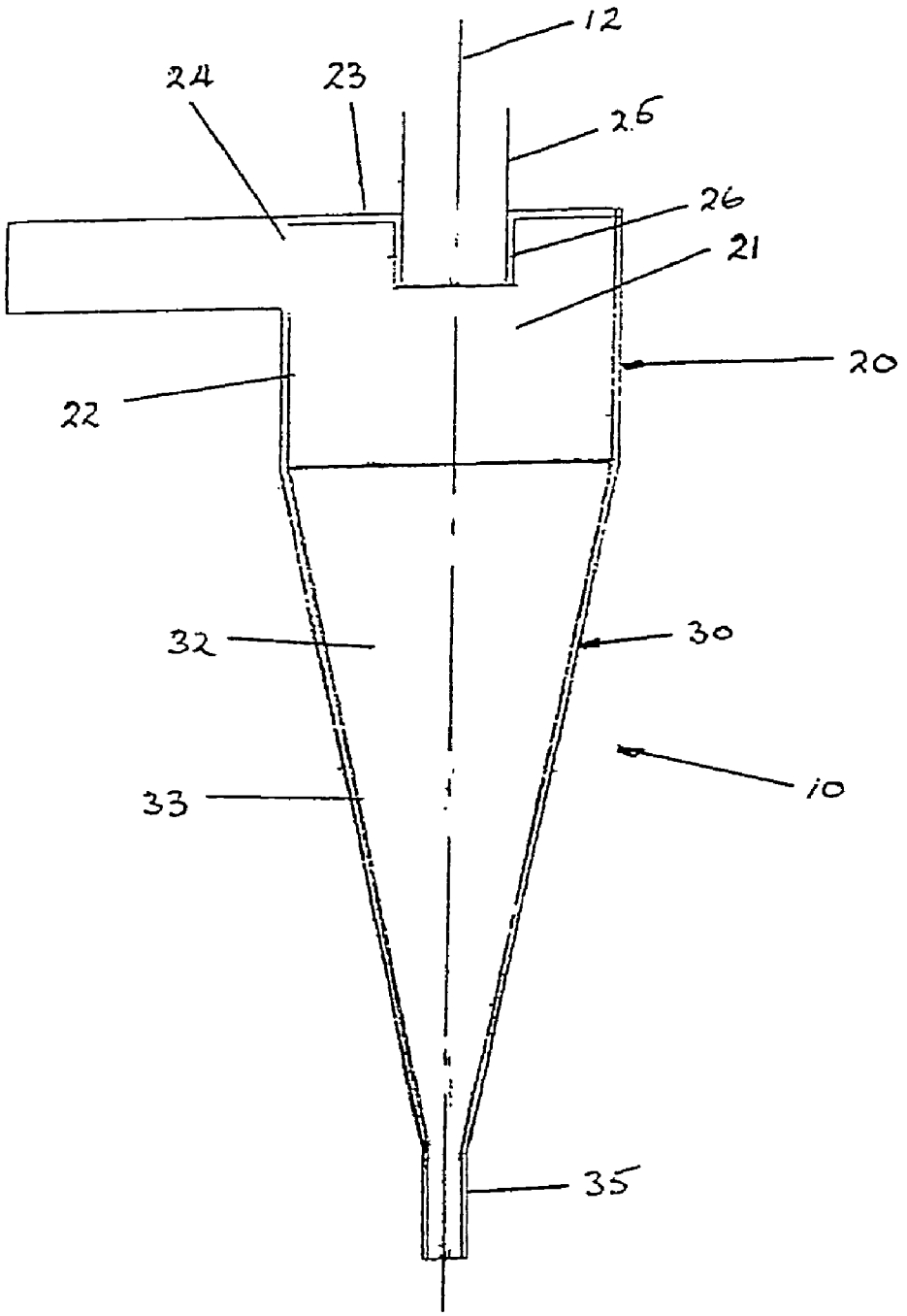
FIG. 1 (Prior Art)
FIG. 1 is a schematic cross-sectional side elevation of a cyclone illustrating its main features.

FIG. 1 is a schematic side elevation of a cyclone 10 illustrating its main features.

Preferably, the second sector of the volute extends around the inner wall for an angle ranging from 200° to 380°.

The cyclone 10, when in use, is normally orientated with its central axis 12 being disposed upright. The cyclone 10 includes an inlet head 20, having a feed chamber 21 therein with an inner side wall 22 and a top wall 23. An inlet port 24 provides for delivery of material to be separated to the feed chamber 21. An overflow outlet 25 is provided in the top wall 23 and a vortex finder 26 extends into the feed chamber 21. Downstream of the inlet head 20 is a separating section 30 which has a separating chamber 32 with a conically shaped inner wall 33. An under flow outlet 35 is provided at the end of the separating section 30. The present invention is particularly concerned with an improved inlet head for a cyclone.

Figure 2:
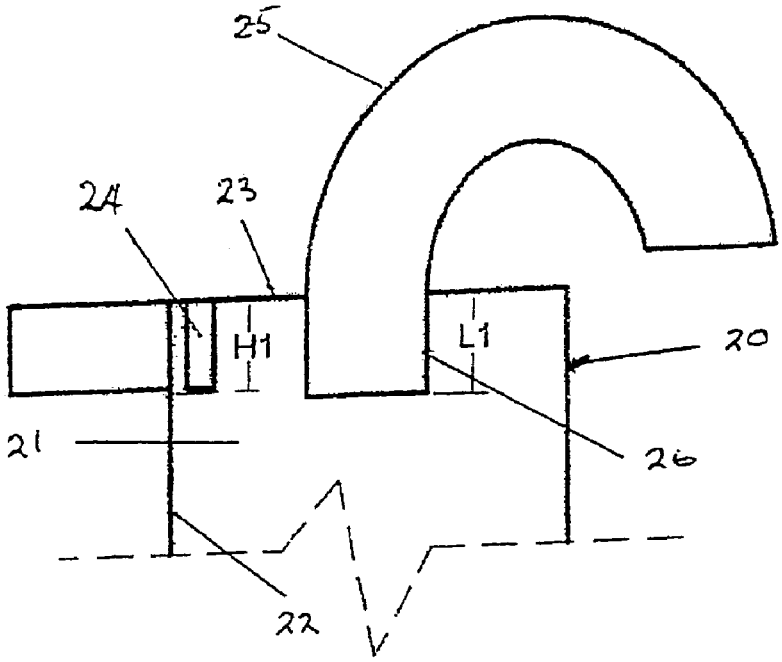
FIG. 2 (Prior Art)
FIG. 2 is a schematic cross-sectional side elevation of an inlet head of a conventional cyclone.
Figure 3:
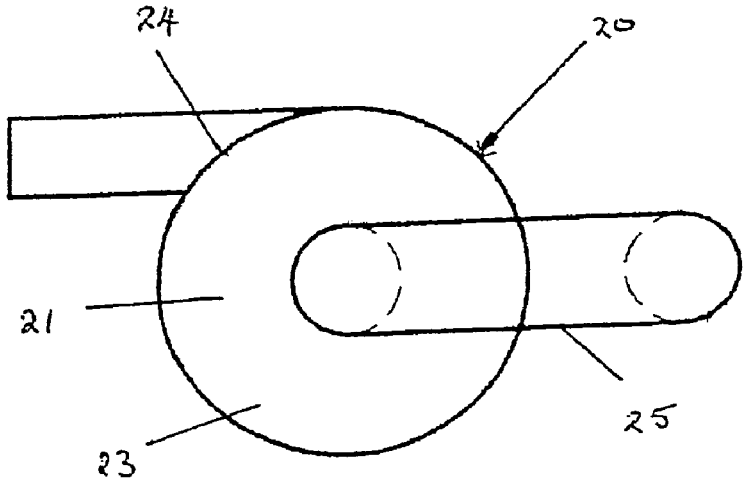
FIG. 3 (Prior Art)
FIG. 3 is a plan view of the inlet head shown in FIG. 2.

FIGS. 2 and 3 illustrate a typical inlet head which is currently known. As shown the inlet port 24 is generally rectangular in cross section and has a height dimension H1 in the direction of the central axis. The feed into the chamber 21 is generally tangential to the inner side wall 22. The vortex finder 26 extends into the feed chamber a distance L1 from the top wall 23. Generally, in known cyclones L1 is greater than H1.

Figure 4:
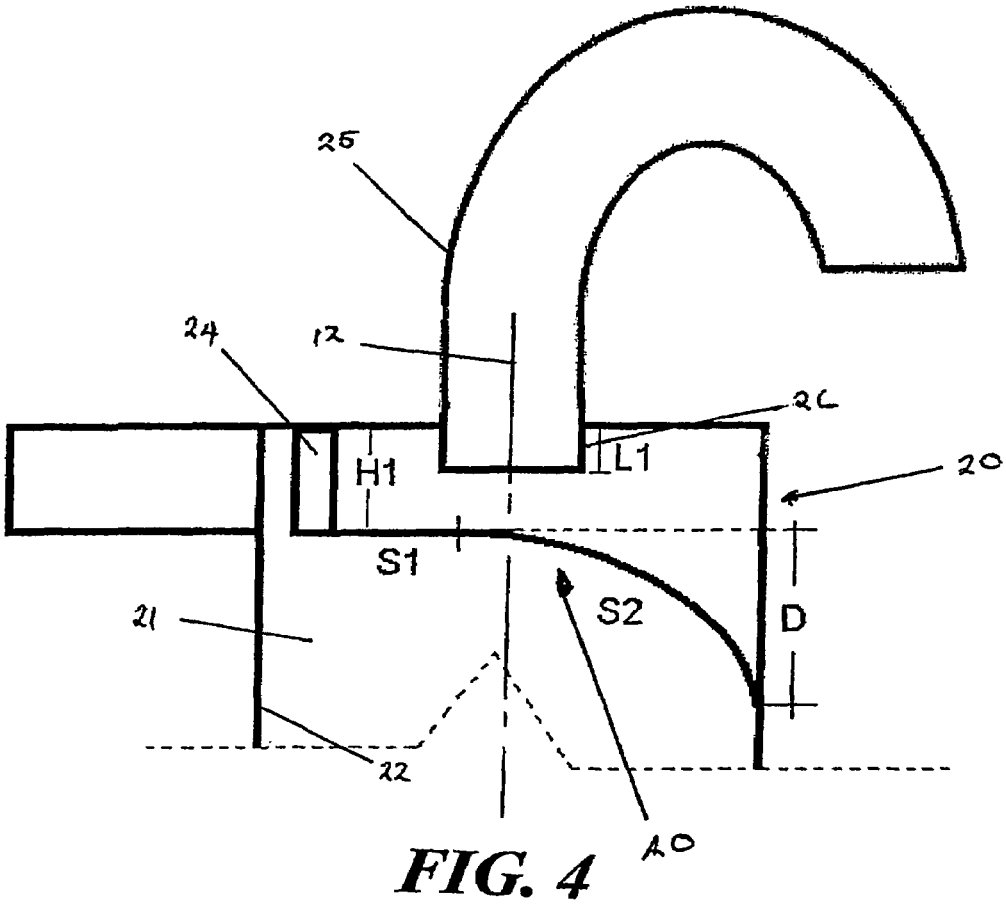
FIG. 4 is a schematic cross-sectional view of an inlet head for a cyclone according to the present invention.
Figure 5:
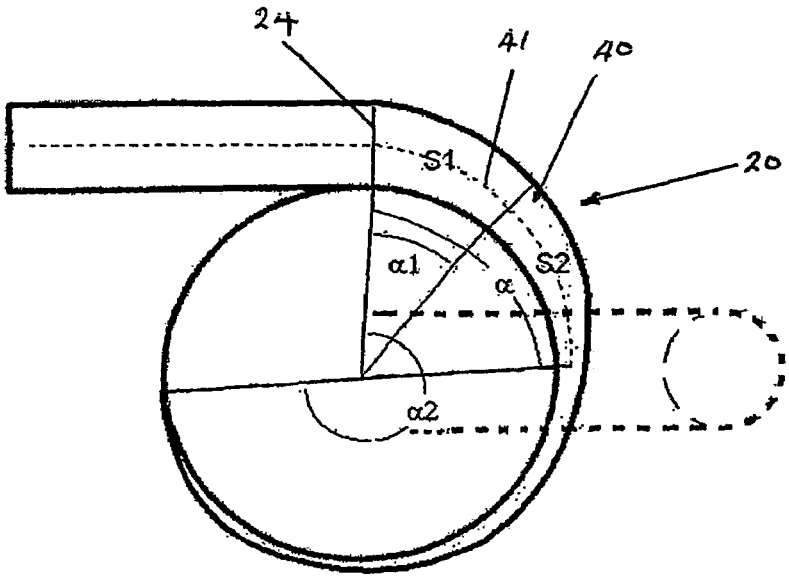
FIG. 5 is a plan view of the inlet head shown in FIG. 4.

The inlet head 20 of the present invention is shown in FIGS. 4 and 5. Like reference numerals to those used earlier have been used to identify like parts. As shown the inlet head includes a feed inlet zone 40 which extends from the inlet port 24. The inlet zone 40 is in the form of a volute having a volute axis 41 and includes a first sector S1 which is generally horizontally disposed and extends along the side wall for an angle $\alpha$1 and a second sector S2 downstream of the first sector S 1, the second sector extending around the side wall for an angle $\alpha$2 and downwardly in the direction of the central axis for a distance D for every 90° of progression around the side wall.

As shown the distance from the volute axis 41 to the central axis 12 progressively decreases from the inlet port 24. Furthermore, the length L1 of the vortex finder is less than dimension H1. It has been found that the fraction F of L1 to H1 can range from 0 to 0.95. Desirably D is from 0.25 H1 to H1 for every 90° progression of the volute. Furthermore the variation of the generatrix radius of the volute S1 plus S2 with the angle $\alpha$ must continuously decrease; that is it does not contain any singular points and preferably is a straight line or curve. The angle $\alpha$2 preferably ranges from 200° to 380°.

Finally, it is to be understood that various alterations, modifications and/or additions may be incorporated into the various constructions and arrangements of parts without departing from the spirit or ambit of the invention.

I claim:

1. An inlet head for a cyclone, comprising:

an inlet head including a feed chamber therein having an inner side wall, a top wall at one end of the inner side wall, an open end at the other end of the side wall opposite said top wall, the open end being of circular cross-section with a central axis, an inlet port adjacent the top wall for delivering material to be separated to the feed chamber, the inlet port having a feed height dimension H1 in the direction of the central axis, an overflow outlet in the top wall which is coaxial with the central axis, and a vortex finder at the top wall extending into the feed chamber in the direction of the central axis a distance L1 from the top end wall;

a feed inlet zone in the inner side wall of the feed chamber having an upstream end adjacent the inlet port and a downstream end extending away from said inlet port in a direction away from the top end wall, the feed inlet zone being defined by a volute having a volute axis extending around the inner side wall and including a first sector in which the volute is generally at right angles to the central axis and a second sector in which the volute extends around the side wall away from the top end wall and generally in the direction of the central axis a distance D;

wherein the distance from the volute axis to the central axis decreases with the progression of the volute around the inner side wall in a direction away from the inlet port; and wherein the distance L1 is a fraction F of the feed height dimension H1.

2. An inlet head according to claim 1 wherein the inlet port is generally rectangular in cross-section.

3. An inlet head according to claim 2 wherein the first sector progresses horizontally from the inlet port around the inner side wall for an angle $\alpha$1 which ranges from 0° to 100°.

4. An inlet head according to claim 1 wherein the fraction F is from 0 to 0.95.

5. An inlet head according to claim 4 wherein the first sector progresses horizontally from the inlet port around the inner side wall for an angle $\alpha$1 which ranges from 0° to 100°.

6. An inlet head according to claim 1 wherein the first sector progresses horizontally from the inlet port around the inner side wall for an angle $\alpha$1 which ranges from 0° to 100°.

7. An inlet head according to claim 6 wherein the second sector descends from the horizontal plane and it extends in the direction of the central axis over a distance D ranging from 0.25×H1 to 1×H1 for every 90° of progress around the inner side wall.

8. An inlet head according to claim 6 wherein the second sector of the volute extends around the inner wall for an angle ranging from 200° to 380°.

9. An inlet head according to claim 1 wherein the second sector descends from the horizontal plane and it extends in the direction of the central axis over a distance D ranging from 0.25×H1 to 1×H1 for every 90° of progress around the inner side wall.

10. An inlet head according to claim 9 wherein the second sector of the volute extends around the inner wall for an angle ranging from 200° to 380°.

11. An inlet head according to claim 1 wherein the volute has a generatrix radius extending through said first sector and said second sector, said generatrix radius having an angle $\alpha$, and wherein a straight line or convex curve yields the generatrix radius having an angle at the center axis.

12. An inlet head according to claim 1 wherein the second sector of the volute extends around the inner wall for an angle ranging from 200° to 380°.

* * * * *